United States Patent [19]

Brown

[11] 4,024,925

[45] May 24, 1977

[54] EQUIPMENT HANDLING APPARATUS

[76] Inventor: Joe R. Brown, P.O. Box 19236, Houston, Tex. 77024

[22] Filed: Jan. 12, 1976

[21] Appl. No.: 648,128

[52] U.S. Cl. ..... 175/85; 173/147

[51] Int. Cl.[2] ..... E21B 19/00; E21B 15/00

[58] Field of Search ..... 175/85; 173/147, 151; 214/62 R

[56] References Cited

UNITED STATES PATENTS

| | | | |
|---|---|---|---|
| 2,972,388 | 2/1961 | Thornburg | 173/147 |
| 3,682,259 | 8/1972 | Cintract et al. | 175/85 |
| 3,721,305 | 3/1973 | Mayer | 173/147 |
| 3,741,315 | 6/1973 | Hilton | 173/147 |
| 3,835,936 | 9/1974 | Lagerstedt et al. | 173/147 |
| 3,917,005 | 11/1975 | Cannon et al. | 173/147 |

*Primary Examiner*—James A. Leppink
*Attorney, Agent, or Firm*—Browning, Bushman & Zamecki

[57] ABSTRACT

Apparatus for manipulating equipment by selectively holding it in a gripping device mounted on a movable closed-loop belt. In the particular embodiment shown, a swivel and elevator combination is mounted on a brace which runs along a track in the derrick of a well workover rig. A belt chain is joined to the brace to form a closed loop, and is motor-driven to raise or lower the swivel and elevator arrangement to move drill pipe or casing into or out of a well.

16 Claims, 12 Drawing Figures

12

EQUIPMENT HANDLING APPARATUS

BACKGROUND OF THE INVENTION

1. Field of the Invention

The present invention relates to apparatus for manipulating equipment. More particularly, the present invention pertains to apparatus for raising and lowering drill pipe or well casing along a derrick and manipulating such pipe or casing into or out of a well.

2. Description of the Prior Art

In prior arrangements for manipulating drill pipe or well casing into or out of a well, the pipe gripping device, which may be a swivel and/or an elevator, is suspended from a traveling block located generally within a derrick structure. The traveling block in turn in suspended by multiple strands of cable from a crown block mounted at the top of the derrick. A single strand of the cable passes over the crown block down to the drum of a drawworks mounted on the derrick floor or just below it. Such an arrangment involves elements which are usually massive and expensive, and is inherently dangerous. The multiple strands of cable between the traveling block and the crown block, necessary in order to achieve a desirable mechanical advantage, as well as the fact that the cable is turned on the drawworks drum means that the cable itself is considerably longer than the height of the derrick. Consequently, in addition to whatever load of drill pipe or well casing is being lifted, the crown block must support the weight of the traveling block as well as that of considerable length of cable. The drawworks itself introduces special problems into drilling operations. With its usually great mass, the drawworks may be difficult to move and to raise to its working level in setting up a derrick. Furthermore, with its partially open face and spinning drum, the drawworks is a source of danger for the men working on the derrick.

SUMMARY OF THE INVENTION

The present invention features a continuous belt arrangement to provide locomotion to a gripping device used to selectively hold and transport equipment. The belt, which may be guided by pulleys arranged appropriately for the given application, is joined to the gripping device, and may be selectively driven by any appropriate power source. The gripping device moves along with the driven belt following a path defined by the pulleys, or may be constrained to move along a track. The gripping device is equipped to selectively receive and hold the equipment to be manipulated.

In the specific embodiment detailed, the present invention is applied to a workover rig for a well, although the invention may be incorporated into any type of drilling system wherein drill pipe, well casing, or other well equipment must be moved into or out of a bore. A swivel and elevator arrangement is attached to a brace which is constrained to move along a track system incorporated in the workover rig derrick. A chain belt extends from the brace to a single sheave pulley at the top of the derrick and down, within the derrick, to a second single-sheave pulley near the base of the derrick. After passing around the lower pulley, the chain belt extends back to the brace, thereby completing a closed loop. A motor is linked to, and drives, the lower pulley thereby selectively moving the chain belt in one sense or the other around both pulleys. Motion of the chain belt moves the brace, with the swivel and elevator attached, along the track, either toward or away from the well bore. With the derrick positioned so that the swivel and elevator are located generally above the well bore, drill pipe or well casing may be moved into or out of the well as desired.

As applied to a drilling system, the present invention eliminates the need for a traveling block, and reduces the crown block to a single-sheave pulley. The drawworks is also eliminated, since there is no longer any need to store excess cable as the gripping device is being raised above the derrick platform. The chain belt used need be long enough only to pass over the pulleys, and to accommodate the linear movement required for the gripping device.

The simple, single closed-loop system of the present invention differs significantly from several previous patents that feature cables or chains in arrangements deviating from that described hereinbefore as Prior Art. U.S. Pat. No. 2,869,826 to Thornburg involves a complex, two-drum assembly employing two cables, neither one of which forms a simple closed loop. Both the U.S. Pat. No. 3,198,263 to Reischl, and the U.S. Pat. No. 3,867,989 to Hisey and Mitchhart feature a pair of closed loop chains used to rotate sprockets and gears on a device that travels up and down a derrick or mast. However, in both of these latter cases, the chains move relative to the traveling device, and require more complex assemblies to contact and drive the device. The U.S. Pat. No. 3,181,630 to Coburn simply uses two taut chains which an equipment handling device rides by way of sprockets. No closed loops are involved to raise or lower equipment as in the present invention.

DESCRIPTION OF PREFERRED EMBODIMENTS

Figure 3:
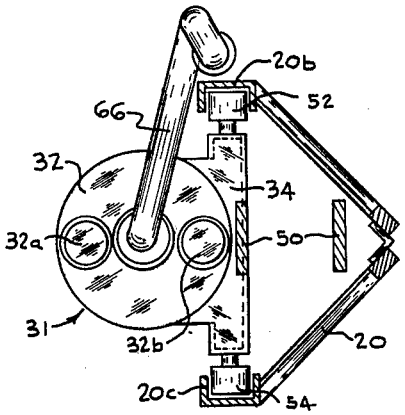
FIG. 3 is a horizontal cross-section, taken along the line 3—3 of FIG. 1.
Figure 2:
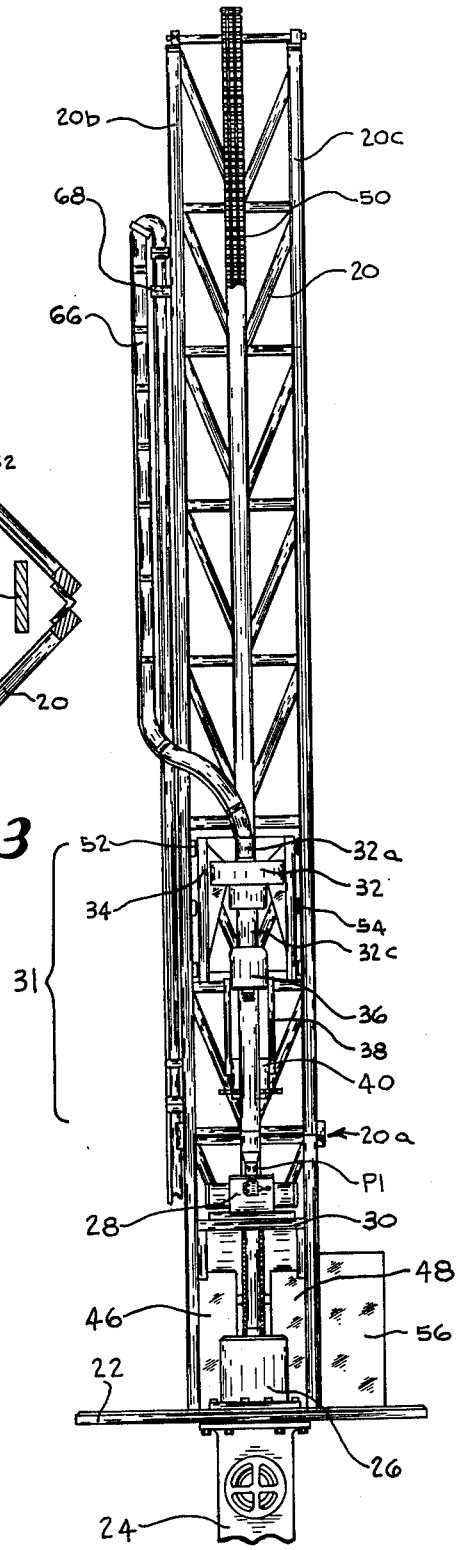
FIG. 2 is a front elevation of the workover rig, shown in FIG. 1.
Figure 4:
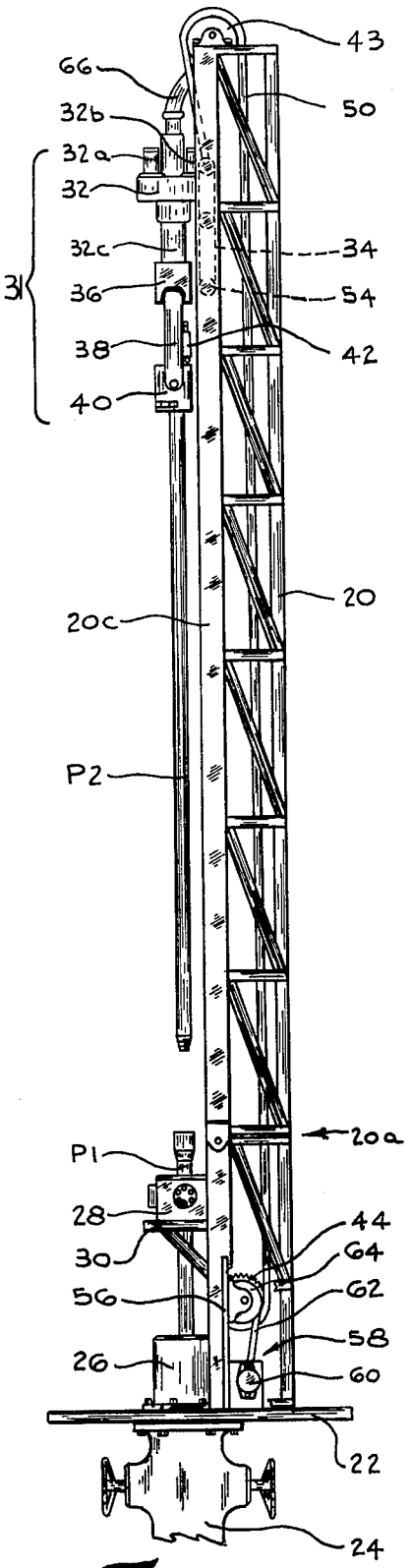
FIG. 4 is a side elevation similar to FIG. 1, showing the gripping device of the workover rig in a raised position.
Figure 5:
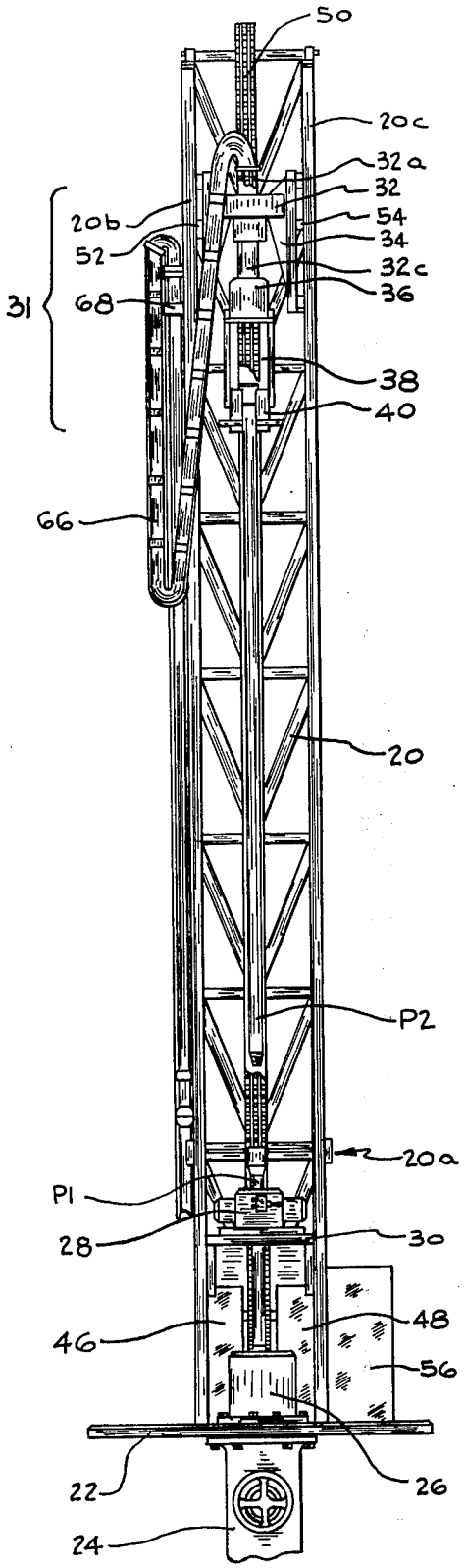
FIG. 5 is a front elevation similar to FIG. 2, with the gripping device in a raised position.

FIGS. 1 through 5 illustrate the application of the present invention to a workover rig. A derrick 20, generally triangular in horizontal cross-section as shown in FIG. 3, sits atop a platform 22, which is in turn bolted to the top of a christmas tree 24 forming the superstructure of a well (not shown). The derrick 20 is hinged at 20*a* for increased portability. A backup slip unit 26 is bolted to the platform 22 over the well bore (not shown). A main slip assembly 28 is supported by a ledge 30 which is fixed to the derrick 20. The slip assembly 28 may be operated manually, or automatically, either by compressed fluid or electrically.

A pipe gripping device is shown generally at 31, and is constructed as follows. A power swivel 32, with two motors 32*a* and 32*b*, is fixed to a brace 34. A drive head 36 is joined to the output shaft 32*c* of the swivel 32. Bales 38 extend from the drive head 36 to an elevator 40. A fluid-actuated piston and cylinder assembly 42 allows the elevator 40 to be selectively tilted with respect to the bales 38. It will be appreciated that the details of the gripping device, including the swivel 32 and the elevator 40, may be altered without deviating from the present invention. For example, the motors 32*a* and 32*b* which drive the swivel 32 may be powered electrically or by compressed fluid. Also, an open-sided, latch-operated elevator 40 is shown, but other designs of elevators may be used. Furthermore, while a power-operated swivel 32 is illustrated as the source of rotary motion for the drill pipe or well casing to be moved into or out of the well bore (not shown), a non-powered swivel may be used in conjunction with a rotary table (not shown) which would be located on the platform 22.

A pulley 43 is fixed at the top of the derrick 20. A second pulley 44 is located within and at the bottom of the derrick 20, mounted on two plates 46 and 48. A chain belt 50 is passed around both of the pulleys 43 and 44, and has its ends joined to the brace 34. The chain belt 50 may also be constructed as a closed loop by itself, with the brace 34 joined thereto. Details of the union of the chain belt 50 and the brace 34 may be altered as required for the given case. It will be appreciated that the closed loop may be formed by devices other than a chain belt. For example, metal cable, chain, rope, or a belt may be used as the application dictates. Variations in the contact surface of the pulleys 43 and 44 will be determined by the nature of the closed loop material. In the present case, the pulleys 43 and 44 must be equipped with cogs appropriate for receiving the chain belt 50.

As best seen in FIG. 3, the derrick 20 is made up partly of two tracks 20*b* and 20*c*. The brace 34 is equipped with two sets of guide rollers 52 and 54, which are positioned to fit loosely within the tracks 20*b* and 20*c*, respectively. The guide rollers 52 and 54 constrain the brace 34 to move along the path defined by the pair of tracks 20*b* and 20*c*.

An additional mounting plate 56 at the base of the derrick 20 supports a drive assembly shown generally at 58, used to move the chain belt 50 around the pulleys 43 and 44 in one sense or the other, thereby raising or lowering the brace 34. The drive assembly at 58, which may be varied to accommodate the given application without deviating from the present invention, is shown selectively operable by a motor 60. A closed-loop drive chain belt 62 passes around the drive shaft (not shown) of the motor 60, and over a wheel 64 which is linked to the lower pulley 44. The motor 60, which may be powered electrically or by compressed fluid, is operated to turn the wheel 64 and the lower pulley 44 as desired.

A hose 66 extends partially up the side of the derrick 20, where it is held by a clamp 68, and passes around to the top of the swivel 32. As the brace 34 is raised or lowered, a sufficient length of the flexible hose 66 is available between the clamp 68 and the swivel 32 to maintain the connection of the hose with the swivel. Drilling mud, or other fluids, may be introduced into the well bore (not shown) by way of the hose 66 and a passage (not shown) through the swivel 32 to drill pipe extending from the swivel down into the well.

Figure 1:
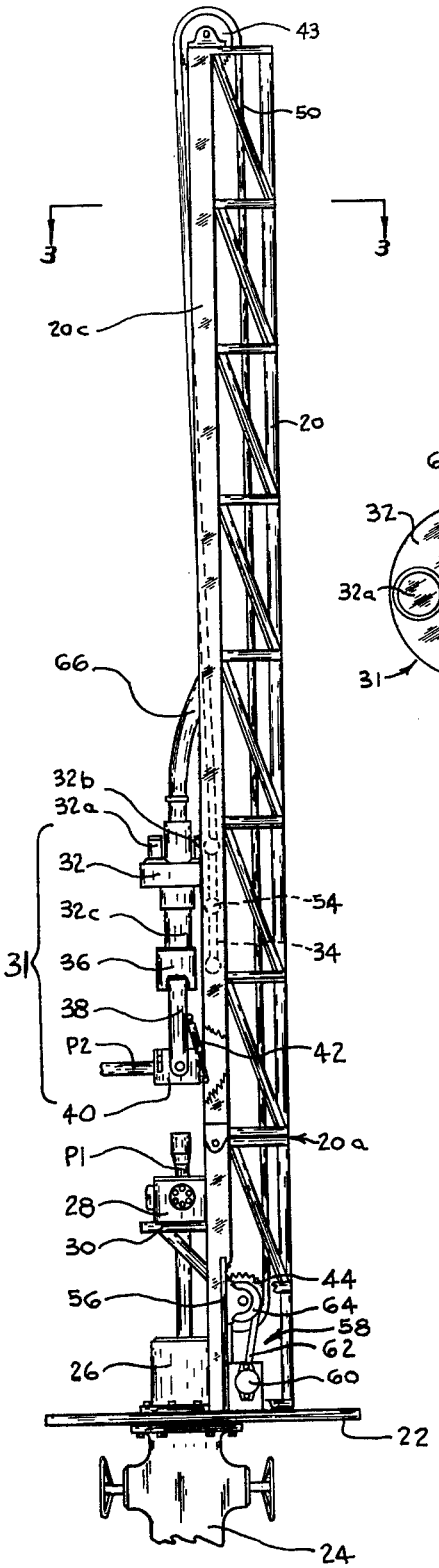
FIG. 1 is a side elevation, partially cut away, illustrating the application of the present invention to a well workover rig.

The workover rig is shown with a pipe member P1 held by the slip assembly 28 and passing down through the christmas tree 24. The elevator 40 may be tilted as shown in FIG. 1 to receive a second pipe member P2, then raised to the position illustrated in FIGS. 4 and 5. Then, the second pipe member P2 is above, and aligned with, the first pipe member P1. The motor 60 may be actuated to advance the chain belt 50 to lower the brace 34, thereby allowing the threaded lower end of the second pipe member P2 to contact the threaded box at the upper end of the first pipe member P1. The second pipe member P2 may then be threaded to the first pipe member P1 by rotation of the swivel 32. The first pipe member P1 may then be released from the slip assembly 28, and the pipe string consisting of pipe members P1 and P2 lowered into the well (not shown). The slip assembly 28 may be used to grip the upper end of the second pipe member P2, the elevator 40 released from the second pipe member, and a subsequent pipe member (not shown) may be received by the elevator, and the process of adding additional pipe members repeated. To withdraw pipe members from the well (not shown), these steps need only be reversed in general in the well known manner. Also, while the pipe members are illustrated as drill pipe, it will be appreciated that comparable steps may be followed to move drill pipe or well casing into or out of the well (not shown).

Figure 7:
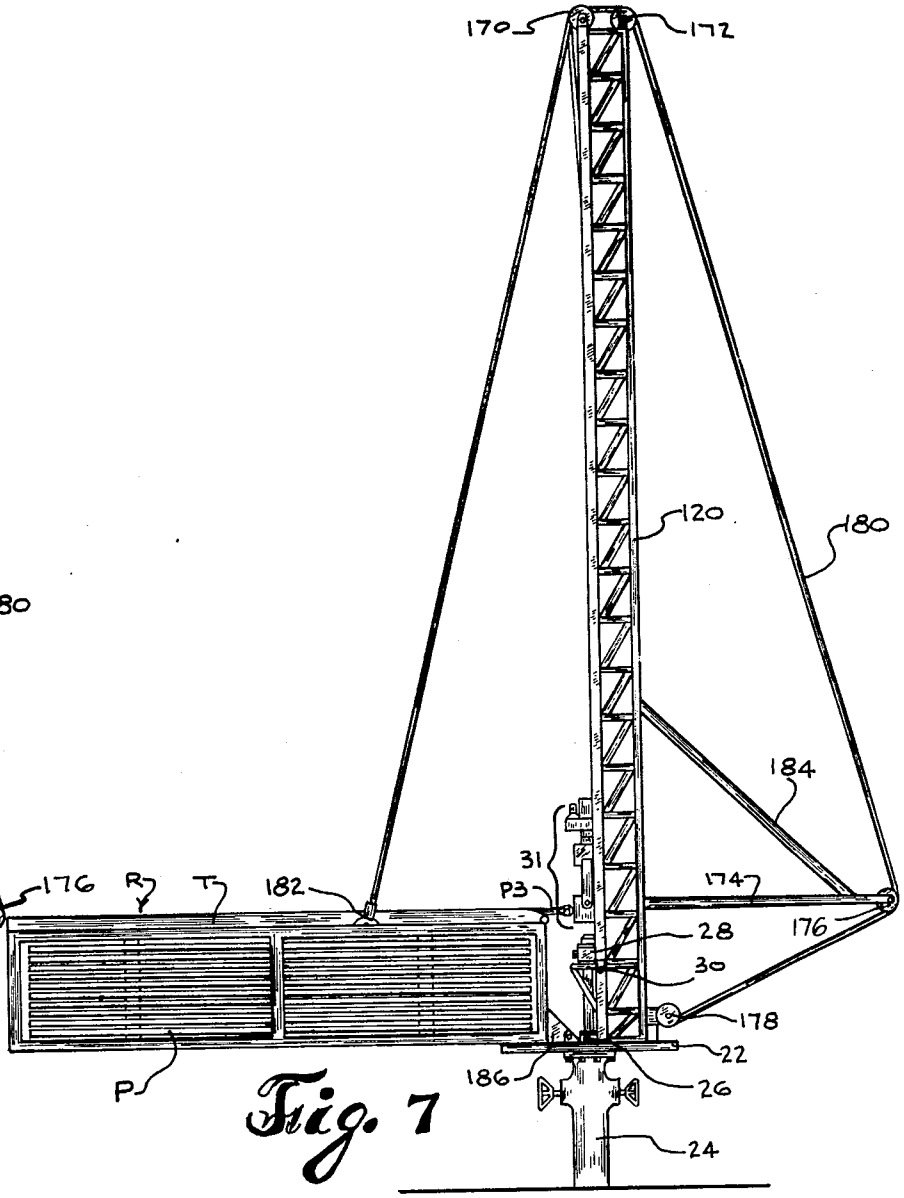
FIG. 7 is a side elevation of the workover rig and storage rack shown in FIG. 6, with the elevator in position to receive a pipe member from the rack.
Figure 6:
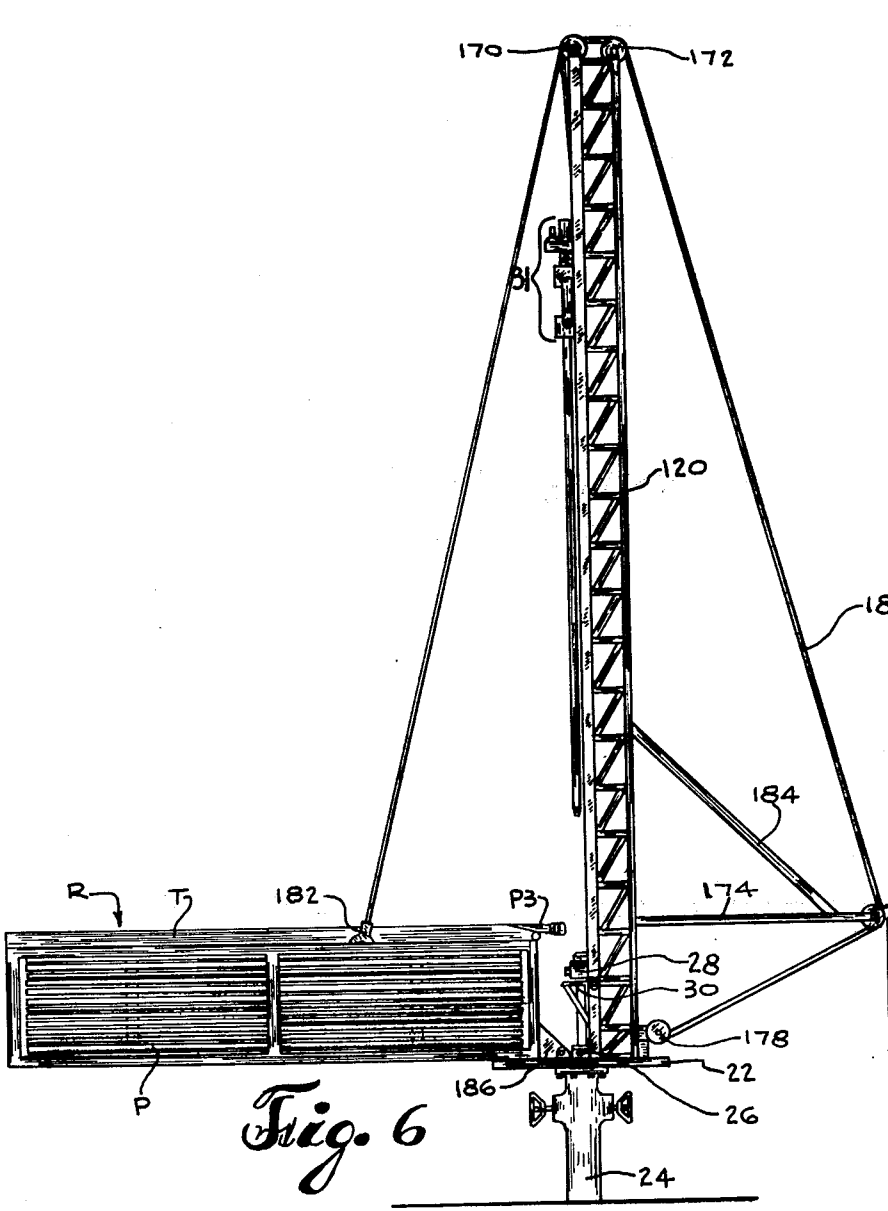
FIG. 6 is a side elevation of the workover rig equipped with a pipe storage rack.

FIGS. 6 and 7 show the addition of a pipe storage rack R to the application of the present invention to the workover rig of FIGS. 1 tnrough 5. However, the derrick 120 is modified to accommodate the pipe rack R. All other elements from FIGS. 1 through 5, such as elements 22 through 31 as shown in FIGS. 6 and 7, remain unchanged with the addition of the pipe rack R. Some details not pertinent to the description of the modification to accommodate the pipe rack R in FIGS. 6 and 7 have been left out of these figures for purposes of clarity.

The derrick 120 is equipped with a pair of pulleys 170 and 172 positioned at the forward and backward top edges of the derrick, respectively. A boom 174 extends horizontally from the back of the derrick 120, and is also equipped with a pulley 176. A slack adjuster and anchoring assembly 178 is fixed near the base of the derrick 120. A cable 180 passes from the slack adjuster and anchoring assembly 178 around the boom pulley 176, over the two pulleys 170 and 172 at the top of the derrick 120, and extends down in front of the derrick 120 to be anchored by a harness 182 at a point on the top of the pipe rack R. A strut 184 between the derrick 120 and the boom 174 prevents upward movement of the boom. The end of pipe rack R that is oriented toward the derrick 120 rests on the platform 22, and is prevented from sliding toward the derrick by a foot 186 that is fixed to the platform. The slack adjuster and anchoring assembly 178 is used not only to maintain the cable 180 taut to properly support the pipe rack R, but may also be used to assist in raising the pipe rack to its position on the platform 22, or to lower it therefrom, by reeling in the cable, or letting it out, respectively.

The pipe rack R, details of which will be discussed hereinafter, may accommodate a plurality of pipe members P. A pipe member P3 may be selectively placed in a trough T of the pipe rack R, as shown in FIG. 6, and advanced toward the derrick 120 to be received by the elevator 40 as shown in FIG. 7. As the elevator 40 is raised up the derrick 120, the opposite end of the pipe member P3 may trail along the trough T. The pipe member P3 may then be oriented in a vertical position over the well bore (not shown). Pipe may be removed from the well (not shown) and returned to the trough T of the pipe rack R by generally reversing this procedure.

Figures 8, 9, 10:
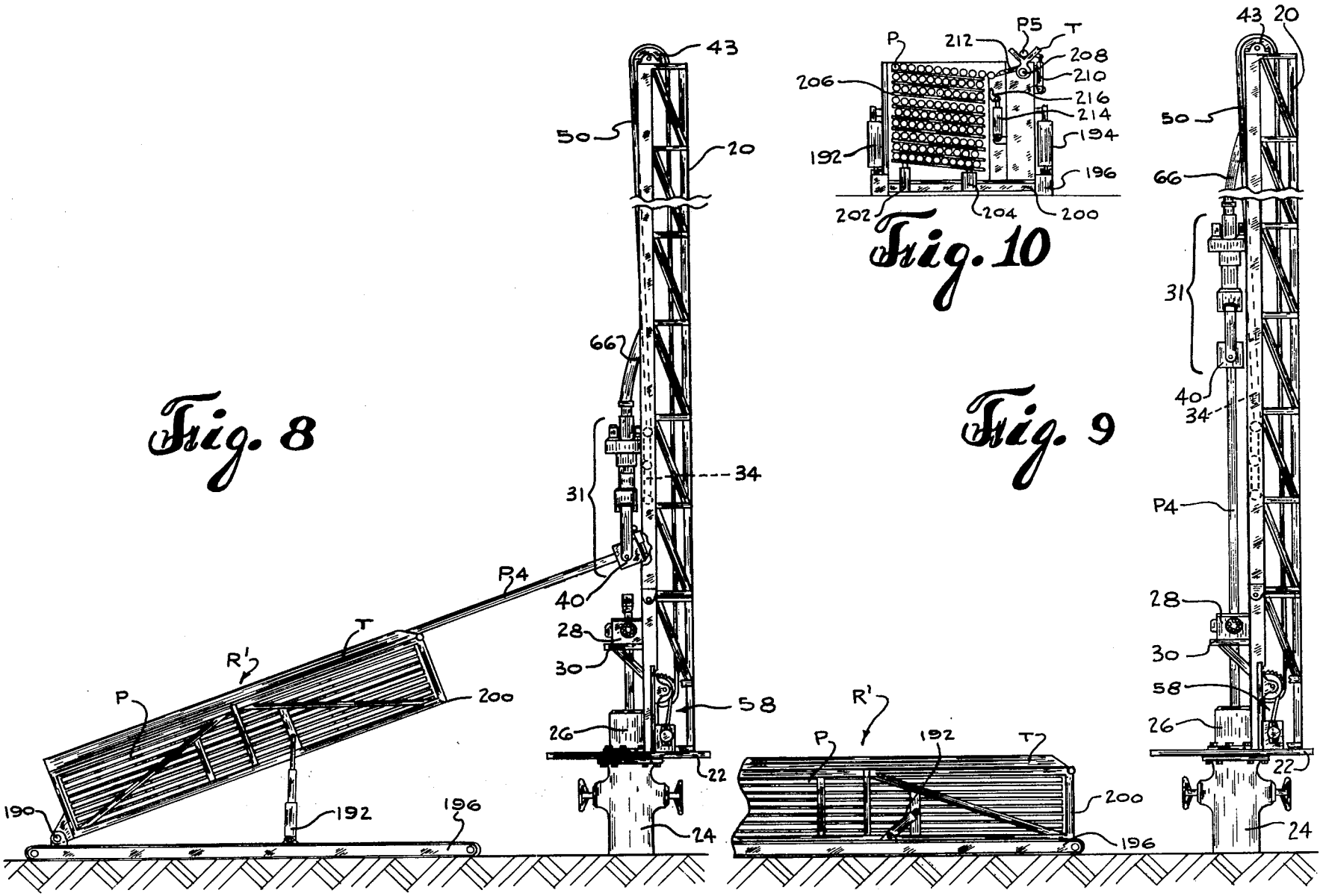
FIG. 8 is a side elevation, partially broken, of the workover rig used in conjunction with a variation of storage rack.
FIG. 9 is a partial side elevation of the workover rig with the storage rack of FIG. 8 in a lowered position.
FIG. 10 is an end elevational view of the pipe rack of FIGS. 8 and 9, in the lowered position.

FIGS. 8 through 10 illustrate a modification of a pipe rack R′ used in conjuction with a workover rig, as shown in FIGS. 1–5, to which the present invention is applied. All elements of the present invention and the workover rig as shown in FIGS. 1–5 are identical in FIGS. 8 and 9.

The pipe rack R′ is mounted by a hinge 190, and a pair of fluid-operated piston and cylinder assemblies 192 and 194, on a skid 196. A plurality of pipe members P may be accommodated by the pipe rack R′, as discussed hereinbefore in relation to the pipe rack version R, and may be selectively advanced to the trough T. The piston and cylinder assemblies 192 and 194 may be selectivly activated in unison to rotate the pipe rack R′ about the hinge 190, thereby aligning the trough T at an appropriate angle so that a pipe member P4 may be advanced along the trough to be received by the elevator 40 in a lowered position. As discussed hereinbefore, the elevator 40 may then be raised up the derrick 20 while the opposite end of the pipe member P4 trails along the trough T until it reaches the end of the trough toward the derrick. The pipe member P4 may then be oriented vertically by rotation of the elevator 40. Pipe may be moved into the trough T from the workover rig by generally reversing this procedure. The piston and cylinder assemblies 192 and 194 may be collapsed as shown in FIG. 9 to allow the pipe rack R′ to rest directly on the skid 196 when pipe members P are not being moved from the pipe rack R′ to the workover rig, or from the workover rig to the pipe rack R′.

Pertinent details of the pipe rack R′ are shown in FIG. 10. Within a framework 200 are located a plurality of fluid-operated piston and cylinder assemblies 202 and 204 (only one of each visible). The piston and cylinder assemblies 202 and 204 support pipe members P on a series of pallets 206. Each pallet 206 rests on the layer of pipe members P below, with the exception that the bottom pallet is supported directly by the piston and cylinder assemblies 202 and 204. The number of pallets 206 in use at any given time is determined by the number of pipe members P contained within the rack R′. All of the piston and cylinder assemblies 202 are raised or lowered in unison; similarly, all of the piston and cylinder assemblies 204 are raised or lowered in unison. The pallets 206 may be tilted toward one side or the other of the pipe rack R′ by selectively raising or lowering the two sets of piston and cylinder assemblies 202 and 204. Also, the pallets 206 may be raised or lowered by appropriately actuating the two sets of piston and cylinder assemblies 202 and 204 in unison.

The trough T is supported on the framework 200 along the upper edge of one side of the pipe rack R′, and is rotatable about a plurality of hinges 208 (only one visible). A tilting fluid-operated piston and cylinder assembly 210 controls the angle of tilt of the trough T about the hinges 208. A plurality of pipe guides 212 (only one visible) extend from the location of the trough T in a direction toward the interior of the pipe rack R′. A plurality of lifting fluid-operated piston and cylinder assemblies 214 (only one visible) are located between the region occupied by the pallets 206 and that part of the framework 200 that supports the trough T. A foot 216 tops each of the lifting piston and cylinder assemblies 214.

To move pipe members P from the pipe rack R′ to the workover rig, the pipe rack R′ is raised to an appropriate angle by actuation of the piston and cylinder assemblies 192 and 194 as shown in FIG. 8. The piston and cylinder assemblies 202 and 204 are adjusted to cause the pallets 206 to tilt toward the area of the trough T as shown in FIG. 10, thereby causing all of the pipe members P on the pallets to be urged toward the side of the pipe rack R′ on which the trough T is located. The pipe members P on the top pallet 206 are prevented from rolling off of the pallet by the pipe guides 212. The pipe members P on all other pallets 206 are stopped by the framework 200. The trough T is tilted toward the pipe members P by actuation of the piston and cylinder assembly 210, and the feet 216 are raised by actuation of the piston and cylinder assemblies 214. The feet 216 lift the pipe member P closest to the trough T, allowing this pipe member to drop into the trough while at the same time preventing additional pipe members on the highest pallet 206 from rolling completely off of the pallet. The trough T is then returned to the position shown in FIG. 10 by actuation of the piston and cylinder assembly 210, and now cradles the pipe member identified as P5. The feet 216 are lowered by actuation of the piston and cylinder assemblies 214, and the pipe members P remaining on the top pallet 206 roll toward the region of the trough T to be held by the pipe guides 212. The pipe member P5 is advanced along the trough T toward the elevator 40, as shown in FIG. 8 in relation to pipe member P4, by a drive assembly (not shown) associated with the trough. Once the pipe member P5 has been removed from the trough T, the process is repeated to deliver a subsequent pipe member to the elevator 40. When all of the pipe members P have been removed from the highest pallet 206, that pallet is removed from the pipe rack R′, and all of the remaining pallets 206 and pipe members P are elevated by actuation of the piston and cylinder assemblies 202 and 204 so that the next pallet is in position to have the pipe members resting thereon delivered to the trough T. This process continues until all of the pipe members P contained in the pipe rack R′, or the desired number, are delivered to the workover rig.

When pipe members P are being withdrawn from the well (not shown), they may be delivered to the trough T and stored in the pipe rack R′ as follows. The piston and cylinder assemblies 202 and 204 are not adjusted to cause the pallets to tilt away from the region of the trough T. A pipe member P is placed in the trough T by the elevator 40, and allowed to slide along the trough until it is in a position to be moved to the top pallet 206. Then, the piston and cylinder assembly 210 tilts the trough T toward the interior of the pipe rack R′, with the result that the pipe member P contained in the trough rolls out of the trough and is guided by the pipe guides 212 to fall onto the highest pallet 206. Because of the tilting of the highest pallet 206 away from the trough T, the pipe member P will move along the pallet away from the trough region until it reaches another pipe member or the framework 200. The trough T is then returned to the position shown in FIG. 10 by actuation of the piston and cylinder assembly 210, and subsequent pipe members P are moved in a similar manner from the workover rig to the pipe rack R'. As each pallet 206 is filled with pipe members P, the piston and cylinder assemblies 202 and 204 lower the pallets 206, and the next pallet is placed on top of the pipe members P to receive additional pipe members from the trough T. In this way, pipe members P may be continually moved from the workover rig to the pipe rack R' until the pipe rack R' is filled, or until no further pipe members are required to be stored. The pipe rack R' may then be returned to the lowered position shown in FIG. 9 by release of the compressed fluid from the piston and cylinder assemblies 192 and 194.

Elements of the pipe rack R' 202 through 216 are essentially identical in the version of the pipe rack R shown in FIGS. 6 and 7, and, with the exception of the operation of the piston and cylinder assemblies 192 and 194, the operation of the pipe rack R is essentially the same as that of the pipe rack R'. It will be appreciated that details of the pipe racks R and R' are not essential to the present invention.

Figure 11:
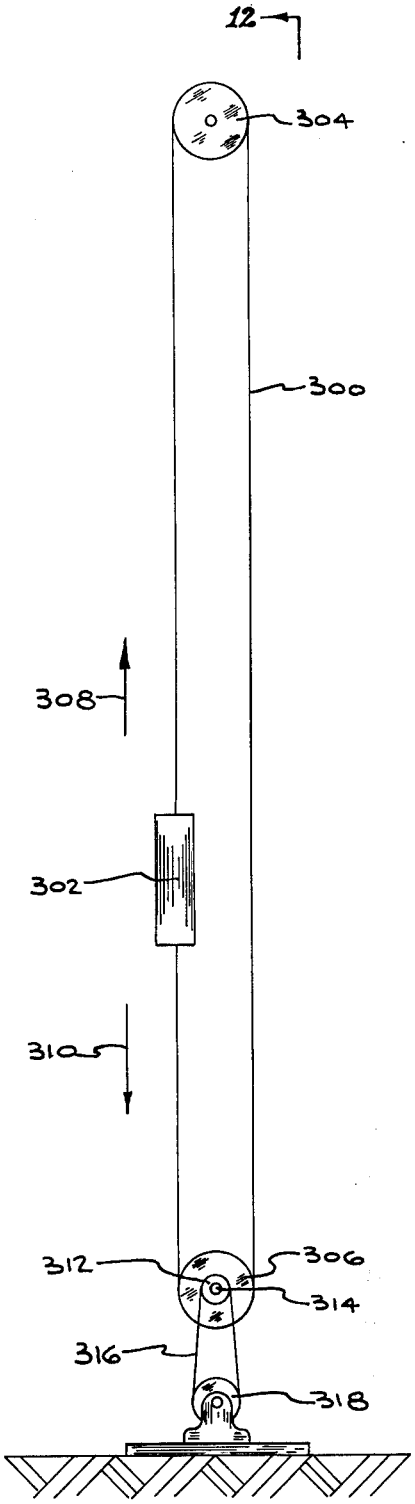
FIG. 11 is a schematic side elevation of the closed loop and the pulley system of the present invention.

FIG. 11 is a schematic representation of the present invention. A closed loop is formed by a belt 300 joined to an equipment gripping device shown schematically as 302. While the belt 300 is indicated as attached to the top and bottom of the gripping device 302, the belt may also be continuous, forming a closed loop by itself, with the gripping device simply attached thereto. The belt 300 passes around two pulleys 304 and 306. Rotation of the lower pulley 306 causes the belt to travel in one sense or the other as indicated by the arrows 308 and 310, thereby causing the gripping device 302 to move upwardly or downwardly accordingly. A wheel 312 is fixed on an axle 314 which passes through the lower pulley 306. A second belt 316 passes around the wheel 312, and is also looped around a drive wheel 318 linked to a motor (not shown). The drive wheel 318 is selectively turned by the motor (not shown) in one direction or the other, thereby causing the belt 316 to rotate the wheel 312 that is linked by the axle 314 to the lower pulley 304. In this way, the motor (not shown) is used to move the gripping device 302 in one direction or the other as indicated by the arrows 308 and 310.

It will be appreciated that the composition and construction of the belts 300 and 316 may be varied according to the needs of the application of the present invention without deviating from the invention. The pulleys 304 and 306 need only be constructed to receive the belt 300; similarly, the wheel 312 and the drive wheel 318 are constructed to receive the belt 316. Typical materials from which the belts 300 and 316 may be constructed, but not excluding other possible materials, include leather, chain, rope, cable, and chain belt. Similarly, the nature and design of the equipment gripping device 302 may be suited to the particular equipment being manipulated, and to the nature of the application. More than two pulleys may also be used with the present invention, as the particular application requires.

Figure 12:
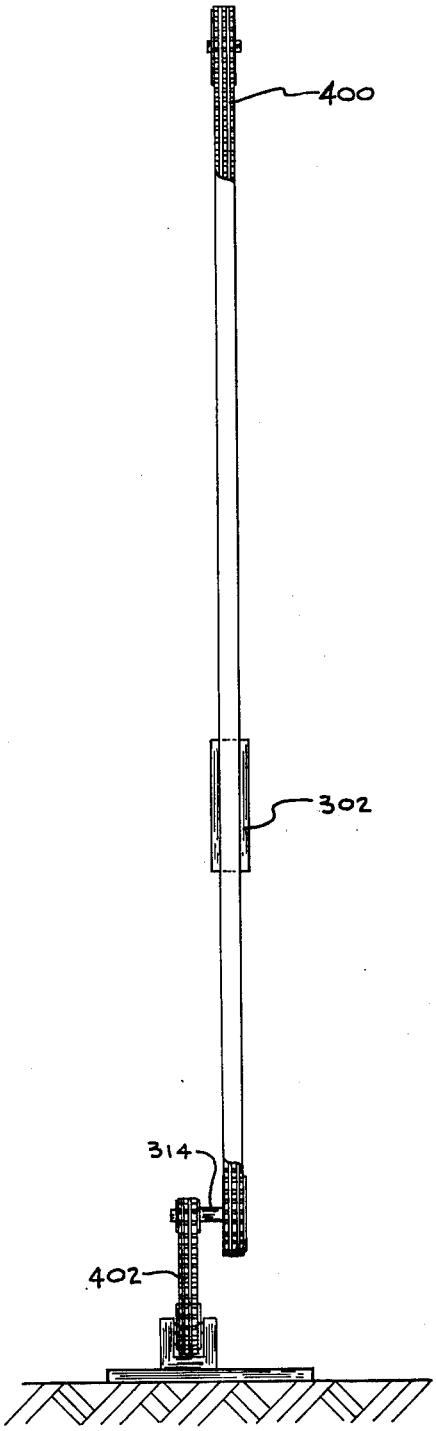
FIG. 12 is a back elevation, partly schematic, showing the use of chain belt in the present invention.

FIG. 12 illustrates the use of chain belt in the present invention. The chain belts 400 and 402 are shown in FIG. 12 only as examples of the type of construction that may be used for the belts 300 and 316, respectively, shown in FIG. 11. Also, it will be appreciated that the chain belts 400 and 402 are the type that may be used for the chain belts 50 and 62, respectively, employed in the workover rig as illustrated in FIGS. 1–9.

It will be appreciated that, while a workover rig has been illustrated, the present invention may be employed in other types of drilling rigs in general, and in manipulating drill pipe or well casing as well as tools or other equipment used in well drilling or working. Furthermore, the present invention may be used in any type of situation in which items of movable equipment in general, and pipes in particular, are required to be moved from one place, or orientation, to another.

The foregoing disclosure and description of the invention is illustrative and explanatory thereof, and various changes in the size, shape and materials as well as in the details of the illustrated construction may be made within the scope of the appended claims without departing from the spirit of the invention.

I claim:

1. Apparatus for manipulating equipment, for use in relation to a bore, comprising:

a. support structure means;
b. at least two pulley means;
c. track means joined to said support structure means, and which may be oriented to run generally toward and away from said bore;
d. swivel means constrained to movement along said track means;
e. elevator means supported by said swivel means and including means for selectively gripping said equipment;
f. powered tilt means for selectively pivoting said elevator means with respect to said swivel means;
g. belt means passing around said pulley means, and joined to said swivel means against substantial motion relative thereto along said track means, forming a closed loop; and
h. drive means, linked to at least one of said pulley means, for selectively moving said belt means about said pulley means to cause said swivel means and said elevator means to selectively move along said track means as said belt means moves.

2. Apparatus for manipulating equipment as defined in claim 1 wherein said belt means comprises chain belt means.

3. Apparatus for manipulating equipment as defined in claim 1 further comprising rotary power means for selectively rotating said equipment.

4. Apparatus for manipulating equipment as defined in claim 3 wherein said rotary power means drives said swivel means to cause said rotation of said equipment.

5. Apparatus for manipulating equipment as defined in claim 1 wherein said belt means comprises cable means.

6. Apparatus for manipulating equipment as defined in claim 1 wherein said pulley means are carried by said support structure means generally adjacent respective opposite ends of said track means.

7. Apparatus for manipulating equipment as defined in claim 1 wherein the pivotal movment of said elevator means is about an axis generally transverse to said track means.

8. A system for manipulating well equipment comprising:

a. derrick means comprising track means;

b. first pulley means;

c. second pulley means;

d. brace means, constrained to move along said track means;

e. swivel means, fixed to said brace means;

f. elevator means supported by said swivel means and including means for selectively gripping said well equipment;

g. powered tilt means for selectively pivoting said elevator means with respect to said swivel means;

h. belt means joined to said brace means against substantial motion relative thereto along said track means, forming a closed loop, and passing around said first pulley means and said second pulley means; and i. drive means, linked to and for selectively turning said first pulley means, to selectively move said belt means about said first pulley means and said second pulley means, thereby moving said brace means, swivel means and elevator means along said track means as said belt means moves.

9. A system for manipulating well equipment as defined in claim 8 further comprising rotary power means for rotating said equipment.

10. A system for manipulating well equipment as defined in claim 8 wherein said belt means comprises chain belt means.

11. A system for manipulating well equipment as defined in claim 8 wherein said swivel means further comprises rotary power means for rotating said equipment.

12. A system for manipulating well equipment as defined in claim 11 wherein said belt means comprises chain belt means.

13. A system for manipulating well equipment as defined in claim 11 further comprising pipe rack means adjacent said derrick means, said elevator means being positionable adjacent said pipe rack means for gripping a pipe thereon.

14. Apparatus for manipulating well equipment as defined in claim 13 wherein said track means extends generally vertically, wherein said pipe rack means is adapted to present a pipe to said elevator means with one end of said pipe adjacent said elevator means and one end of said pipe distal said elevator means, and wherein said elevator means is adapted to grip said pipe at said one end, whereby, upon operation of said drive means, said one end of said pipe may be raised and lowered with respect to said other end.

15. Apparatus for manipulating well equipment as defined in claim 8 wherein said pulley means are carried by said derrick means generally adjacent respective opposite ends of said track means.

16. Apparatus for manipulating well equipment as defined in claim 8 wherein the pivotal movement of said elevator means is about an axis generally transverse to said track means.

* * * * *

UNITED STATES PATENT AND TRADEMARK OFFICE

CERTIFICATE OF CORRECTION

PATENT NO. : 4024925

DATED : May 24, 1977

INVENTOR(S) : Joe R. Brown

It is certified that error appears in the above-identified patent and that said Letters Patent are hereby corrected as shown below:

In Column 4, line 27, insert --then-- after "may".

In Column 6, line 62, delete "not" and insert therefor --now--.

Signed and Sealed this

*First* Day of *November 1977*

[SEAL]

*Attest:*

RUTH C. MASON
*Attesting Officer*

LUTRELLE F. PARKER
*Acting Commissioner of Patents and Trademark*